US012691338B2

(12) United States Patent
Schulz et al.

(10) Patent No.: US 12,691,338 B2
(45) Date of Patent: Jul. 28, 2026

(54) SPORT BALL RETRIEVING SYSTEM

(71) Applicant: The Ball Caddy, LLC, Daleville, AL (US)

(72) Inventors: Torsten Schulz, Ooltewah, TN (US); William Turner, Daleville, AL (US)

(73) Assignee: THE BALL CADDY, LLC, Daleville, AL (US)

( * ) Notice: Subject to any disclaimer, the term of this patent is extended or adjusted under 35 U.S.C. 154(b) by 1019 days.

(21) Appl. No.: 17/760,469

(22) PCT Filed: Feb. 10, 2021

(86) PCT No.: PCT/US2021/017324
§ 371 (c)(1),
(2) Date: Aug. 10, 2022

(87) PCT Pub. No.: WO2021/163093
PCT Pub. Date: Aug. 19, 2021

(65) Prior Publication Data

US 2023/0076649 A1 Mar. 9, 2023

Related U.S. Application Data

(60) Provisional application No. 62/972,391, filed on Feb. 10, 2020.

(51) Int. Cl.
*A63B 47/02* (2006.01)
*A63B 102/02* (2015.01)
(Continued)

(52) U.S. Cl.
CPC ..... *A63B 47/02* (2013.01); *A63B 2102/02* (2015.10); *A63B 2102/18* (2015.10);
(Continued)

(58) Field of Classification Search
CPC . A63B 47/02; A63B 2102/02; A63B 2102/18; A63B 2102/182; A63B 2102/20; A63B 2102/32
See application file for complete search history.

(56) References Cited

U.S. PATENT DOCUMENTS 1,937,828 A 12/1933 Macdonald
2,027,546 A 1/1936 Macdonald
(Continued)

FOREIGN PATENT DOCUMENTS

KR 20180112605 A 10/2018

*Primary Examiner* — Sang K Kim
(74) *Attorney, Agent, or Firm* — Michael E. Dockins; Shumaker, Loop & Kendrick, LLP

(57) ABSTRACT

A ball retriever assembly for retrieving and storing balls includes a hopper body defining a hollow storage space therein and at least one attachment configured for removable coupling to the hopper body. Each of the attachments includes a retrieval structure configured for unidirectional passage of one of the balls through the corresponding one of the attachments. A lid is configured for removable coupling to the hopper body as well as each of the attachments. The lid is adjustable between a ball retrieval configuration wherein the lid encloses an end of the hollow storage space and a ball removal configuration wherein the lid forms a stand for maintaining an upright and open configuration of the hopper body. The different attachments configured for removable coupling to the hopper body allow for the unidirectional passage of different ranges of outer ball diameters.

20 Claims, 7 Drawing Sheets

(51) Int. Cl.
*A63B 102/18* (2015.01)
*A63B 102/20* (2015.01)
*A63B 102/32* (2015.01)

(52) U.S. Cl.
CPC ..... *A63B 2102/182* (2015.10); *A63B 2102/20* (2015.10); *A63B 2102/32* (2015.10)

(56) References Cited

U.S. PATENT DOCUMENTS

| | | | | | |
|---|---|---|---|---|---|
| 2,203,170 | A | | 6/1940 | Macdonald | |
| 5,188,410 | A | * | 2/1993 | Summers | A63B 47/02 473/460 |
| 5,292,161 | A | | 3/1994 | Green | |
| 5,433,491 | A | * | 7/1995 | Green | A63B 47/02 206/315.9 |
| 5,476,297 | A | | 12/1995 | Lombard | |
| 5,634,680 | A | * | 6/1997 | Green | A63B 47/02 206/315.9 |
| 5,755,632 | A | * | 5/1998 | Eddy | A63B 47/02 224/919 |
| 7,922,608 | B1 | | 4/2011 | Shoham | |
| 2002/0151390 | A1 | | 10/2002 | Niksich | |
| 2005/0052040 | A1 | | 3/2005 | Hellerson | |
| 2014/0306471 | A1 | | 10/2014 | Vital, Jr. | |

* cited by examiner

SPORT BALL RETRIEVING SYSTEM

CROSS-REFERENCE TO RELATED APPLICATION

This patent application claims priority to U.S. Provisional patent application Ser. No. 62/972,391, filed on Feb. 10, 2020, the entire disclosure of which is hereby incorporated herein by reference.

FIELD OF THE INVENTION

The present invention relates generally to a device used as an accessory for sporting games, and more particularly, a device configured for picking up and temporarily storing sporting balls of a variety of different diameters, wherein such sporting balls may include softballs, baseballs, tennis balls, cricket balls, or golf balls.

BACKGROUND OF THE INVENTION

Baseball, softball, tennis, cricket, and golf have a combined sum of over 127 million participants in the United States. This number nearly triples if the worldwide population is considered. It is well known and understood that increased interest in these five sports has carried with it the need to establish multiple practice areas, facilities, and devices.

Training for such sports may include the need for multiple practice balls to be employed during a single training session in order to maximize the efficiency of the training session. For example, such sports typically require the athlete in training to strike, throw, or otherwise interact with multiple balls from a common location before then retrieving and storing each of the balls for a subsequent training session. This process can be time consuming and cumbersome, and may even reduce the desire of the athlete to engage in such training sessions.

Additionally, it is also common for the listed sports to require different devices and structures for retrieving and/or storing such balls due to the variable diameters of the associated balls. For example, a device suitable for retrieving and/or storing a golf ball is not typically able to be adapted for retrieving and/or storing a softball due to the drastic difference in the diameters of the respective balls. As a result, participation in multiple sports may require the athlete to purchase and maintain multiple different devices for retrieving and/or storing such balls, which can be cost prohibitive while also disadvantageously requiring additional storage space. The same problem may also be encountered by a family having multiple different members that enjoy practicing different combinations of the listed sports.

Devices suitable for aiding in the retrieval and storage of multiple sports balls are disclosed in each U.S. Pat. No. 1,937,828 (1933), U.S. Pat. No. 2,027,546 (1936), and U.S. Pat. No. 2,203,170 (1940), each of which lists Ian MacDonald as the sole inventor. However, each of these ball retrieval devices is suited for only a single type of ball, hence the same problems posed above are faced when using such devices.

Based on the foregoing, it is desirable to produce a ball retrieval and storage device that is adaptable to multiple different applications (sports), convenient and easy to use, easily manufactured in a cost effective manner, and lightweight and easy to store when not in use.

SUMMARY OF THE INVENTION

Compatible and attuned with the present invention, an improved ball retrieval and storage device is disclosed.

In one embodiment of the invention, a ball retriever assembly for retrieving and storing balls comprises a hopper body defining a hollow storage space therein and at least one attachment configured for removable coupling to the hopper body. Each of the at least one attachments includes a retrieval structure configured for unidirectional passage of one of the balls through the corresponding one of the at least one attachments.

In another embodiment of the invention, a kit for forming a ball retriever assembly is disclosed. The kit comprises a hopper body defining a hollow storage space therein and a plurality of attachments. Each of the attachments is configured for removable coupling to the hopper body. Each of the attachments includes a retrieval structure configured for unidirectional passage of balls therethrough. Each of the retrieval structures is configured for the unidirectional passage of a different range of ball outer diameters therethrough

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings wherein.

DETAILED DESCRIPTION OF THE INVENTION

Figure 1:
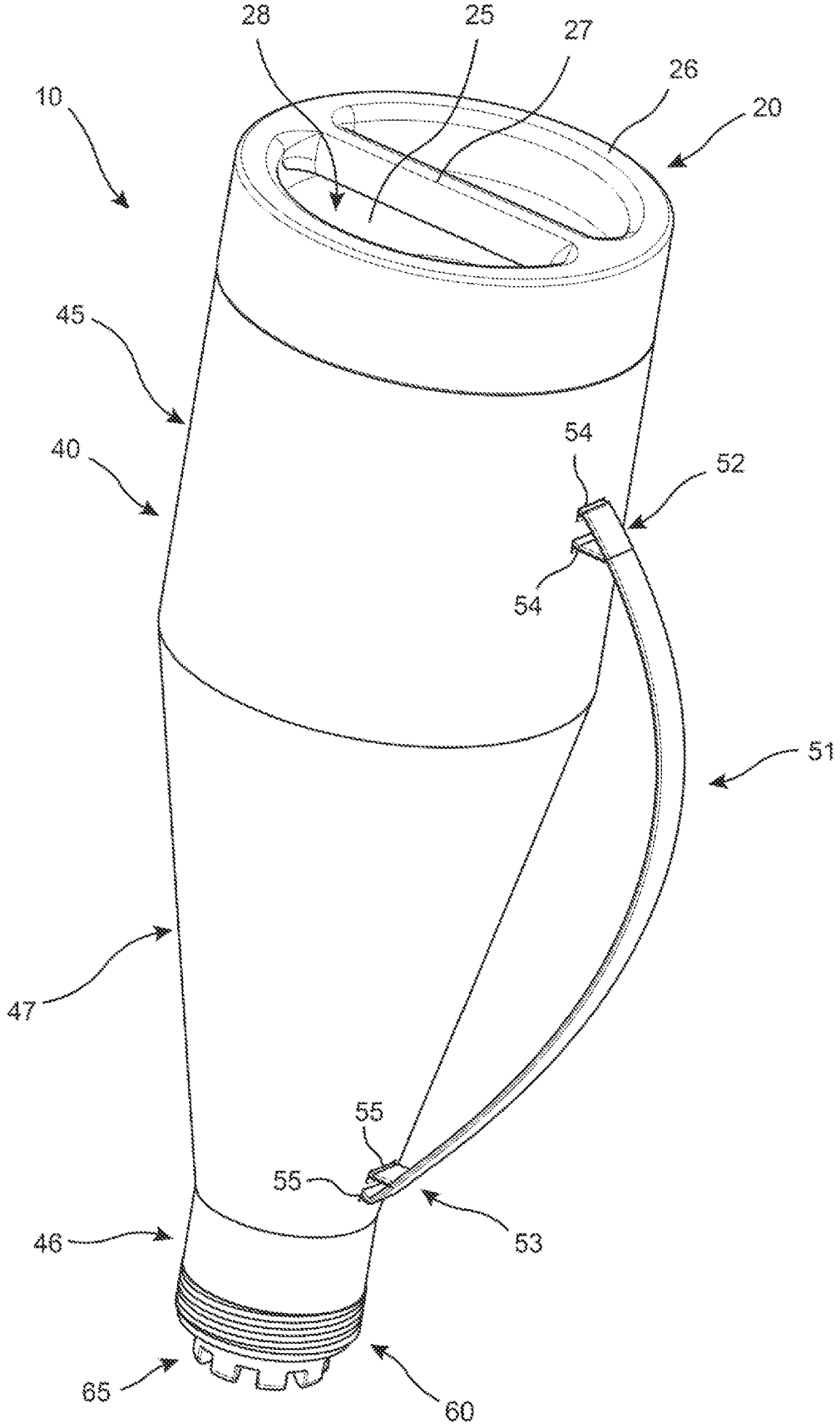
FIG. 1 is a perspective view of a sport ball retriever assembly according to an embodiment of the present invention.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9,1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could alternatively be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIGS. 1-6 illustrate a sport ball retriever assembly 10 according to an embodiment of the present invention, which is hereinafter referred to as the retriever 10 for brevity. The retriever 10 is generally configured for selectively retrieving and then temporarily storing sports balls therein. The retriever 10 may be especially well suited for use during training sessions wherein the use of multiple sports balls is beneficial for most efficiently and time effectively performing the training sessions. However, the retriever 10 may be suited for use in retrieving and storing any substantially spherical or round objects within the context of any process or method while remaining within the scope of the present invention. As used hereinafter, the term "ball" refers to spherical or round balls such as baseballs, softballs, tennis balls, cricket balls, and golf balls, as non-limiting examples. The retriever 10 disclosed herein may be especially well suited for retrieving balls that have a circumference range of about one inch to four inches, but it should also be apparent to one skilled in the art that the retriever 10 may be adapted for the retrieval and storage of balls of any circumference, as desired.

The retriever 10 generally includes a lid 20, a hopper body 40, and an attachment 60. The attachment 60 is configured for removable coupling to the hopper body 40, and the lid 20 is configured for removable coupling to each of the attachment 60 and the hopper body 40. The attachment 60 forms a retrieval mechanism of the retriever 10 and further provides an adapter or fitting for facilitating the indirect removable coupling of the lid 20 to the hopper body 40. The lid 20 is configured to be utilized as a lid for enclosing a storage space of the retriever 10 or as a base or stand structure for vertically orienting the retriever 10 and exposing the interior of the storage space for the removal of any balls temporarily stored therein.

The lid 20 is substantially cylindrical in shape and extends axially from a first end 21 to an opposing second end 22. The lid 20 is divided into a handle segment 23 and a coupling segment 24 with respect to the axial direction of the lid 20, wherein the handle segment 23 is disposed towards the first end 21 and the coupling segment 24 is disposed towards the second end 22. The first end 21 of the lid 20 includes an indentation 25 formed therein and a rim 26 encircling the indentation 25. The indentation 25 may include a substantially concave shape to axially space a central portion of the indentation 25 from an axial position of the rim 26. A handle 27 extends across diametrically opposing portions of the rim 26 to form an opening 28 between the central portion of the indentation 25 and an underside of the handle 27. The opening 28 is configured to receive the fingers of a user of the retriever 10 when the user grasps the handle 27. The handle segment 23 of the lid 20 is accordingly configured to allow for the user to easily grasp and manipulate the retriever 10 when the lid 20 is directly or indirectly coupled to the hopper body 40.

The rim 26 and an axial end surface of the handle 27 are disposed to be co-planar with respect to a plane arranged perpendicular to the axial direction of the lid 20. The co-planar arrangement of the rim 26 and the handle 27 allows for the lid 20 to form the previously described base or stand or the retriever 10, as explained in greater detail hereinafter.

The coupling segment 24 includes a first threaded portion 30 formed on an outer circumferential surface 31 of the lid 20. The first threaded portion 30 begins at the second end 22 of the lid 20 and extends axially along a portion of the outer circumferential surface 31 before terminating adjacent the boundary present between the handle segment 23 and the coupling segment 24 with respect to the axial direction of the lid 20. The first threaded portion 30 may alternatively be referred to hereinafter as the outer threaded portion 30 or the male threaded portion 30 of the lid 20 by virtue of the threads thereof being formed on an outer surface of the lid 20 that is received within an opening forming a portion of a corresponding female component.

The coupling segment 24 further includes a bore 32 formed therein. The bore 32 extends axially from the second end 22 of the lid 20 towards the first end 21 thereof and terminates adjacent the boundary present between the handle segment 23 and the coupling segment 24 with respect to the axial direction of the lid 20. The bore 32 is substantially cylindrical in shape and is arranged concentrically with respect to a central axis of the lid 20. An inner circumferential surface 33 of the lid 20 partially defining the bore 32 includes a second threaded portion 34 formed thereon. The second threaded portion 34 begins at the second end 22 of the lid 20 and extends axially along the inner circumferential surface 33 towards an axial end surface of the bore 32 disposed towards the first end 21 of the lid 20. The second threaded portion 34 may alternatively be referred to hereinafter as the inner threaded portion 34 or the female threaded portion 34 of the lid 20 by virtue of the threads thereof being formed on an inner surface of the lid 20 that defines an opening used to receive a male component therein.

The lid 20 may be formed from any substantially rigid material capable of withstanding the forces applied to the retriever 10 during the retrieval and storage of the balls as described herein. The lid 20 may be formed by a molding or casting process, as desired. However, other manufacturing processes suitable for achieving the shape and configuration of the lid 20 may alternatively be utilized without departing from the scope of the present invention. The lid 20 may be formed from a polymeric material such as a suitable thermoplastic material or thermosetting material, as desired. However, other rigid materials may be used to form the lid 20, including aluminium and alloys thereof or steel and alloys thereof, as non-limiting examples.

The hopper body 40 is a thin-walled structure extending axially from a first end 41 to an opposing second end 42 thereof. A circumferential wall 43 of the hopper body 40 is divided into a first cylindrical segment 45 including the first end 41 of the hopper body 40, a second cylindrical segment 46 including the second end 42 of the hopper body 40, and a tapered segment 47 having a frustoconical shape for axially connecting the first cylindrical segment 45 to the second cylindrical segment 46. The first cylindrical segment 45 includes a larger diameter than the second cylindrical segment 46, and the tapered segment 47 is tapered to connect the varying diameters of the adjacent segments 45, 46. The first cylindrical segment 45 may have an outer diameter of about 10 inches while the second cylindrical segment 46 may have an outer diameter of about 4.5 inches, as one non-limiting example. The first cylindrical segment 45 may alternatively be referred to hereinafter as the large diameter segment 45 while the second cylindrical segment may alternatively be referred to hereinafter as the small diameter segment 46, as desired. The small diameter segment 46 may further be referred to as a neck of the hopper body 40, as desired.

The circumferential wall 43 includes an inner circumferential surface 48 and an outer circumferential surface 49. The inner circumferential surface 48 defines a hollow storage space 50 within the hopper body 40 configured for receiving at least one ball therein during use of the retriever 10. The storage space 50 includes an inner diameter along the small diameter segment 46 that is at least as large as an outer diameter of the largest ball suitable for use with the retriever 10. The storage space 50 then constantly increases in diameter within the tapered segment 47 before reaching a maximum inner diameter within the large diameter segment 45. The inner diameter of the storage space 50 along the large diameter segment 45 may be selected to allow for a desired quantity of balls to be able to be stored within the storage space 50 at a given time. An axial length of each of the tapered segment 47 and the large diameter segment 45 may also be selected to facilitate the storage space 50 having a desired volume for holding a desired quantity of the balls.

A strap 51 is coupled to the hopper body 40 and is configured to aid in carrying the retriever 10 during the retrieval of the balls or the relocation of any balls stored within the retriever 10. The strap 51 is presented as an elongate strip of material having a first looped portion 52 at one end of the strip and a second looped portion 53 at an opposing end of the strip. The circumferential wall 43 of the hopper body 40 may include a first pair of openings 54 formed therethrough and configured to receive the first looped portion 52 therein as well as a second pair of openings 55 formed therethrough and configured to receive the second looped portion 53 therein, thereby securing the opposing ends of the strip of material forming the strap 51 to the hopper body 40. In the illustrated embodiment of the retriever 10 the first pair of openings 54 is formed through the large diameter segment 45 while the second pair of openings 55 is formed through the tapered segment 47 adjacent the smaller diameter segment 46, but alterative positions of the openings 54, 55 may be selected while remaining within the scope of the present invention, so long as the strap 51 maintains the ability to support the retriever 10 when being relocated by the user. The strap 51 may also be coupled to the hopper body 40 utilizing alternative coupling means or mechanisms, including the use of any suitable fasteners, adhesives, releasable connections, or the like, as desired.

The hopper body 40 further includes a first threaded portion 57 and a second threaded portion 58. The first threaded portion 57 is formed along the inner circumferential surface 48 of the circumferential wall 43 and begins at the first end 41 of the hopper body 40 before extending axially towards the second end 42 thereof. The first threaded portion 57 may extend axially along at least a portion of the large diameter segment 45, and may terminate prior to the formation of the first pair of openings 54 within the circumferential wall 43. The first threaded portion 57 may alternatively be referred to as the inner threaded portion 57 or the female threaded portion 57 of the hopper body 40, as desired. The second threaded portion 58 is formed along the inner circumferential surface 48 of the circumferential wall 43 and begins at the second end 42 of the hopper body 40 before extending axially towards the first end 41 thereof. The second threaded portion 58 may extend axially along at least a portion of the small diameter segment 46, and may terminate prior to the boundary present between the small diameter segment 46 and the tapered segment 47. The second threaded portion 58 may alternatively be referred to as the inner threaded portion 58 or the female threaded portion 58 of the hopper body 40, as desired.

The hopper body 40 may be formed from any substantially rigid material capable of withstanding the forces applied to the retriever 10 during the retrieval and storage of the balls as described herein. The hopper body 40 may be formed by a molding or casting process, as desired. However, other manufacturing processes suitable for achieving the shape and configuration of the hopper body 40 may alternatively be utilized without departing from the scope of the present invention. The hopper body 40 may be formed from a polymeric material such as a suitable thermoplastic material or thermosetting material, as desired. However, other rigid materials may be used to form the hopper body 40, including aluminium and alloys thereof or steel and alloys thereof, as non-limiting examples. In some embodiments, at least a portion of the hopper body 40 may be formed from a substantially transparent material, such as a transparent plastic material, to form a window for viewing the contents of the storage space 50 formed within the hopper body 40.

The attachment 60 is substantially cylindrical in shape and extends axially from a first end 61 to an opposing second end 62 thereof. The attachment 60 is divided axially into a first coupling segment 63 including the first end 61, a second coupling segment 64 disposed adjacent the first coupling segment 63, and a retrieval structure 65 disposed adjacent the second coupling segment 64 and including the second end 62. The first coupling segment 63 and the second coupling segment 64 are each substantially cylindrical in shape with the second coupling segment 64 having a larger outer diameter than the first coupling segment 63 to form a shoulder 66 at a boundary therebetween.

The first coupling segment 63 includes a first threaded portion 71 formed in an outer circumferential wall 67 of the attachment 60. The first threaded portion 71 may extend axially across an entirety of a length of the first coupling segment 63. The first threaded portion 71 may hereinafter be referred to as the outer threaded portion 71 or the male threaded portion 71. The second coupling segment 64 includes a second threaded portion 72 formed in the outer circumferential wall 67 of the attachment 60. The second threaded portion 72 may extend axially across an entirety of a length of the second coupling segment 64. The second threaded portion 72 may hereinafter be referred to as the outer threaded portion 72 or the male threaded portion 72. The threads of the first threaded portion 71 are configured for axial insertion of the attachment 60 into the hopper body 40 in an axial direction towards the first end 61 of the attachment 60 while the threads of the second threaded portion 72 are configured for axial insertion of the attachment 60 into the lid 20 in an axial direction towards the second end 62 of the attachment 60.

The retrieval structure 65 is formed by an annular array of circumferentially spaced fingers 75 configured to selectively allow for the passage of a ball 5 into a through hole 73 formed axially through the attachment 60. The fingers 75 are further configured to prevent undesired removal of the balls 5 from the retriever 10 following passage of the balls 5 beyond the fingers 75 during the retrieval process. The structure of the fingers 75 is more thoroughly described hereinafter when discussing a method of operation of the retriever 10.

The attachment 60 may be formed from any resiliently elastically flexible material capable of withstanding the forces applied to the retriever 10 during the retrieval and storage of the balls as described herein. The elastic resiliency of the material forming the attachment 60 allows for the resilient flexing of the fingers 75 as is described in greater detail hereinafter. The attachment 60 may be formed by a molding or casting process, as desired. It may be preferable to form the entirety of the attachment 60 as a single integral or monolithic structure to facilitate the formation of the resiliently flexible fingers 75 in a single manufacturing process, as opposed to coupling an independently provided retrieval structure 65 to the remainder of the attachment 60. However, other manufacturing processes suitable for achieving the shape and configuration of the attachment 60 may alternatively be utilized without departing from the scope of the present invention. The attachment 60 may be formed from a polymeric material such as a suitable thermoplastic material or thermosetting material, as desired. However, other substantially rigid and elastically flexible materials may be used to form the attachment 60, including aluminium and alloys thereof or steel and alloys thereof, as non-limiting examples.

The first (male) threaded portion 30 of the lid 20 is configured for threaded mating with the first (female) threaded portion 57 of the hopper body 40 to removably couple the second end 22 of the lid 20 to the first end 41 of the hopper body 40. An outer diameter of the first threaded portion 30 is accordingly substantially equal to an inner diameter of the first threaded portion 57. The second (female) threaded portion 34 of the lid 20 is configured for threaded mating with the second (male) threaded portion 72 of the attachment 60 to removably couple the second end 22 of the lid 20 to the second coupling segment 64 of the attachment 60. An inner diameter of the second threaded portion 34 is accordingly substantially equal to an outer diameter of the second threaded portion 72. The first (male) threaded portion 71 of the attachment 60 is configured for threaded mating with the second (female) threaded portion 58 of the hopper body 40. An outer diameter of the first threaded portion 71 is accordingly substantially equal to an inner diameter of the second threaded portion 58. In all cases, each of the male threaded portions is rotated relative to the corresponding female threaded portion for facilitating the threaded couplings described herein, wherein rotation of the corresponding male threaded portion in a first rotational direction (i.e. clockwise) corresponds to relative motion between the threaded portions in a first axial direction and rotation in a second rotational direction opposite the first rotational direction corresponds to relative motion between the threaded portions in a second axial direction opposite the first axial direction.

Figure 4:
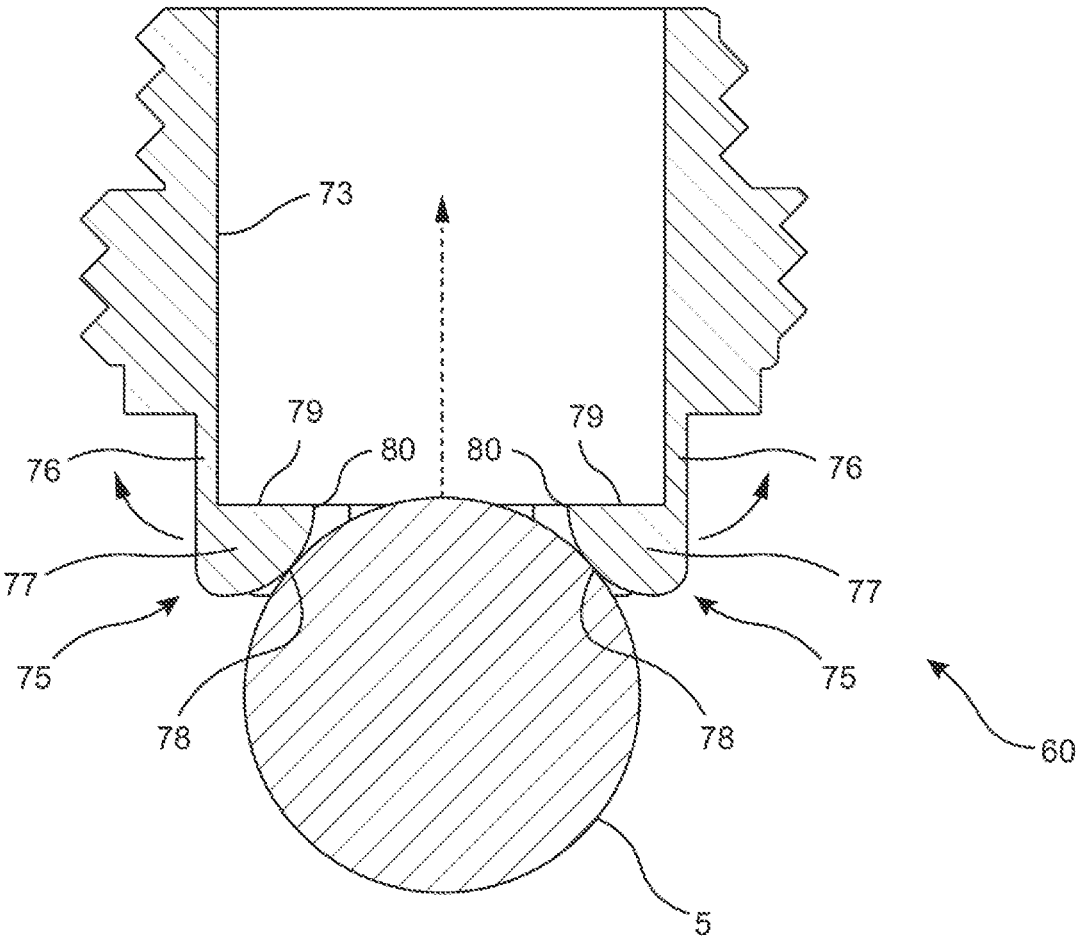
FIG. 4 is an elevational cross-sectional view showing a ball immediately prior to unidirectional passage through a retrieval structure of the sport ball retriever assembly of FIG. 1.
Figure 5:
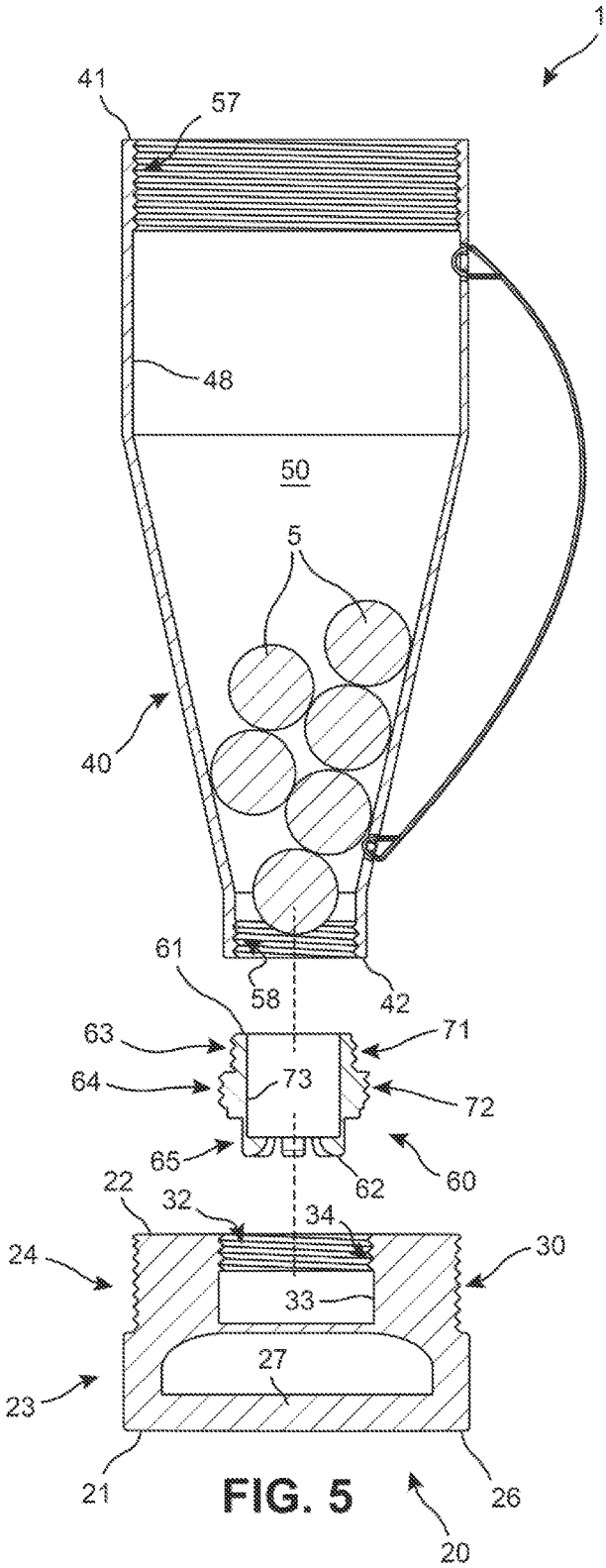
FIG. 5 is an elevational exploded cross-sectional view of the sport ball retriever assembly of FIG. 1 prior to the sport ball retriever assembly being assembled into a ball storage configuration.
Figure 6:
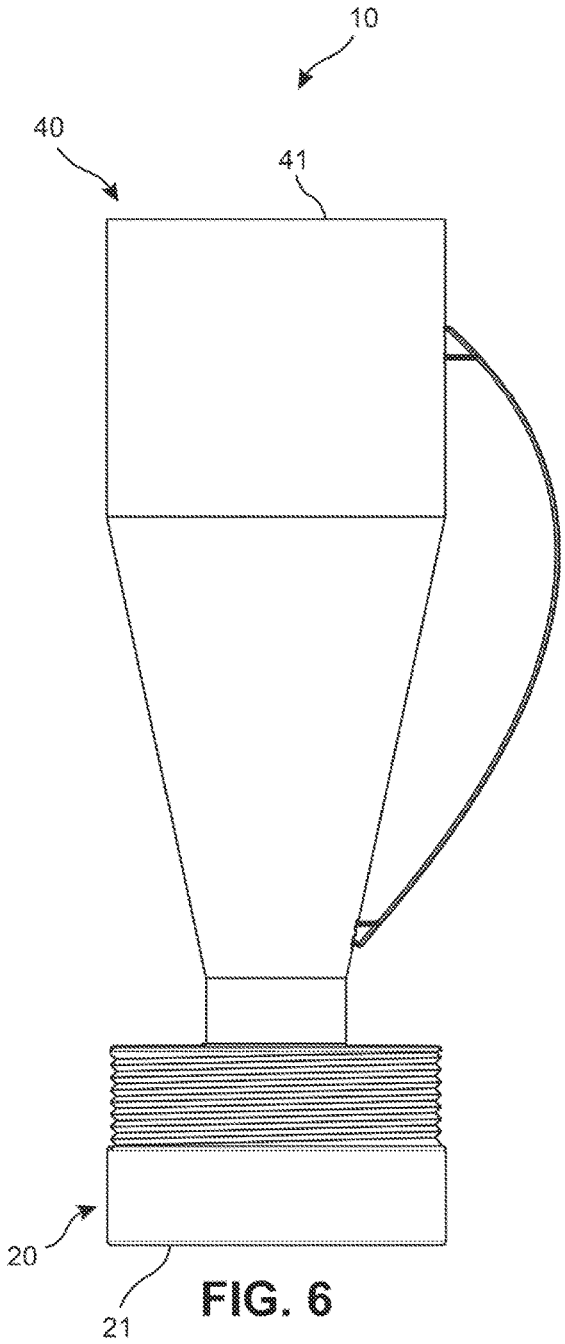
FIG. 6 is an elevational front view of the sport ball retriever assembly when assembled into the ball storage configuration.

The retriever 10 is configured to be operational in both a ball retrieval configuration (FIGS. 1-4) and a ball removal configuration (FIGS. 5 and 6). The ball retrieval configuration refers to a configuration of the retriever 10 wherein the retriever 10 can selectively receive passage of the balls therein for storage within the storage space 50. In contrast, the ball removal configuration refers to a configuration of the retriever 10 wherein the storage space 50 is accessible to the user for removal of the balls 5 when the first end 41 of the hopper body 40 is opened via removal of the lid 20 therefrom.

Figure 2:
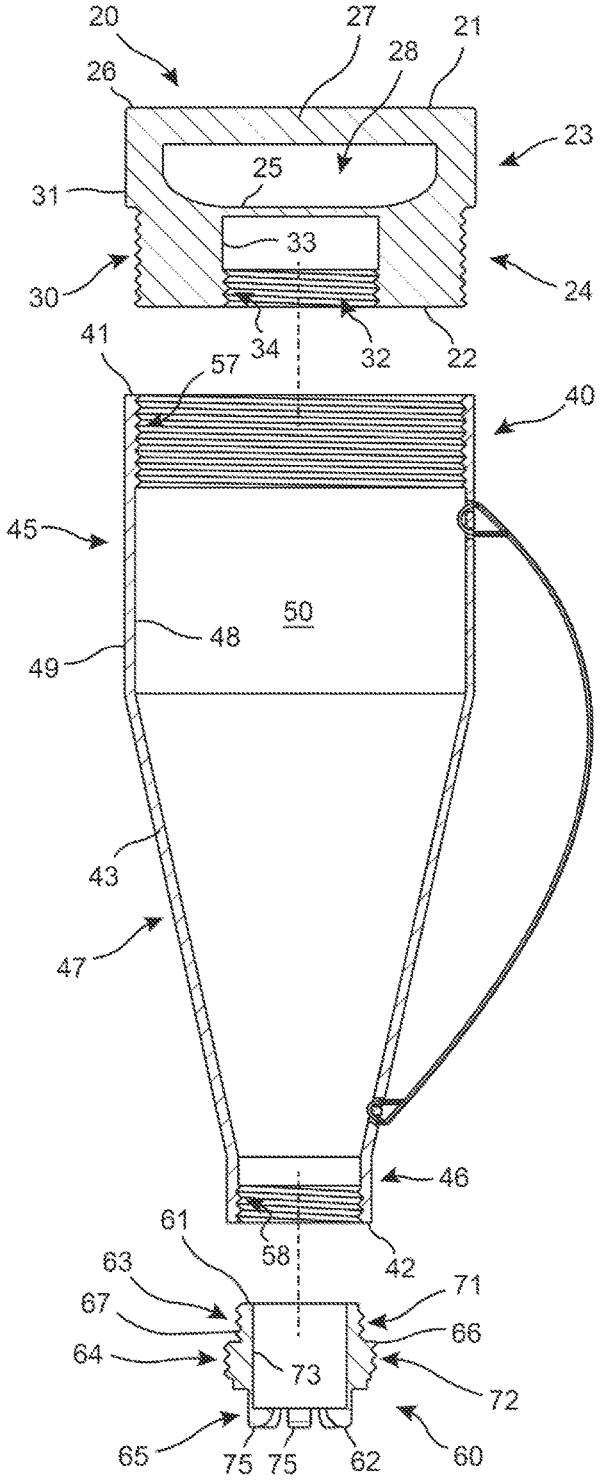
FIG. 2 is an elevational exploded cross-sectional view of the sport ball retriever assembly of FIG. 1 prior to the sport ball retriever assembly being assembled into a ball retrieval configuration.
Figure 3:
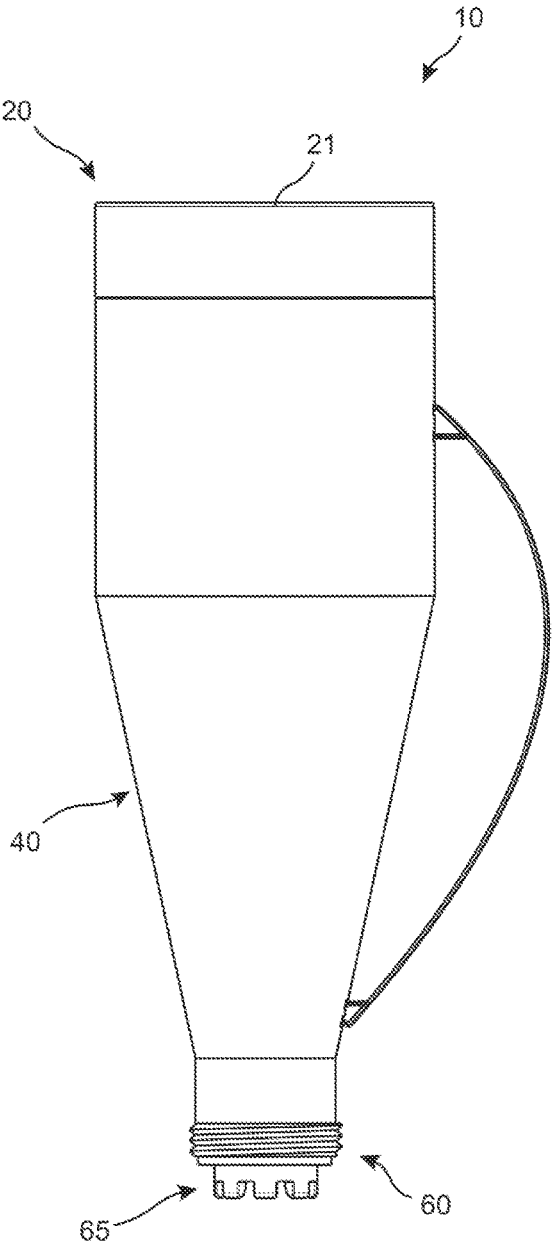
FIG. 3 is an elevational front view of the sport ball retriever assembly when assembled into the ball retrieval configuration.

First, referring to FIGS. 2 and 3, a method of assembling the retriever 10 into the ball retrieval configuration is disclosed. The second end 22 of the lid 20 is removably coupled to the first end 41 of the hopper body 40 via the threaded mating of the threaded portions 30, 57 such that the lid 20 encloses the first end 41 of the hopper body 40. The first end 61 of the attachment 60 is also removably coupled to the second end 42 of the hopper body 40 via the threaded mating of the threaded portions 58, 71 to place the attachment 60 in position for performing the ball retrieval process. The attachment 60 may be inserted axially into the hopper body 40 until the shoulder 66 formed between the first and second coupling segments 63, 64 contacts the second end 42 of the hopper body 40. The shoulder 66 accordingly allows for the attachment 60 to be tightened and secured to the hopper body 40 to prevent undesired removal therefrom.

The ball retrieval process occurs as follows. The user of the retriever 10 orients the retriever 10 wherein a central axis of the attachment 60 is directed towards a center of a ball 5 in need of retrieval. As shown in FIG. 4, each of the fingers 75 forming the retrieval structure 65 is comprised of an axially extending flexible portion 76 and a radially inwardly extending contact portion 77. Each of the contact portions 77 includes a tapered surface 78 facing at least partially radially inwardly and configured for contact with the ball 5 during the retrieval process. In the illustrated embodiment, each of the tapered surfaces 78 has a convex and arcuate shape that tapers inwardly with respect to the direction of passage of the ball 5 through the attachment 10 during the retrieval process. However, other tapered shapes, such as a constantly radially inwardly sloped shape, may be utilized without necessarily departing from the scope of the present invention. Each of the contact portions 77 further includes a radially extending retaining surface 79 extending between the flexible portion 76 and an edge 80 where the tapered surface 78 meets the retaining surface 79. The edge 80 forms a radially inward surface of each of the fingers 75.

During the retrieval process, the ball 5 is centered among the array of the fingers 75 such that the tapered surfaces 78 of the contact portions 77 are contacting the ball 5. The arcuate and convex shape of each of the tapered surfaces 78 aids in piloting the ball 5 to the centered position for making the contact with each of the tapered surfaces 78. The user then presses the retriever 10 axially towards the ball 5 with the ball 5 forced against a counteracting ground or support surface to force the ball 5 through the retrieval structure 65. The pressing of the retriever 10 towards the ball 5 may include the user grasping the handle 27 of the lid 20 to apply the necessary axial force for facilitating passage of the ball 5 into the through hole 73 of the attachment 60. The axial pressing of the ball 5 against the fingers 75 includes the spherical shape of the ball 5 applying a radially outwardly extending force to each of the tapered surfaces 78 such that continued axial insertion of the ball 5 into the attachment 60 forces each of the fingers 75 to flex radially outwardly until each of the edges 80 are spaced apart to allow for passage of the ball 5 thereby. The flexing of each of the fingers 75 occurs about each of the corresponding flexible portions 76, as indicated by the arrows depicting rotation of the fingers 75 in FIG. 4.

Once the ball 5 has passed by each of the contact portions 77, the fingers 75 are configured to resiliently spring back to their original positions (as shown in FIG. 4) to cause the edges 80 and the retaining surfaces 79 to be positioned radially inwardly to prevent passage of the ball 5 through the retrieval structure 65 in the opposite axial direction to that described during the retrieval process. The fingers 65 accordingly form a resilient snap-fit like relationship with the ball 5 during passage thereof. The retrieval structure 65 is accordingly configured to allow for passage of the ball 5 therethrough with respect to a first axial direction towards the hopper body 40 and to prevent passage of the ball 5 therethrough with respect to a second axial direction arranged opposite the first axial direction and away from the hopper body 40.

The retrieving process may be carried out as many times as is necessary to collect as many balls 5 as can be suitably received within the storage space 50. Each of the balls 5 may temporarily rest within the through hole 73 of the attachment 60 prior to being pushed axially further into the storage space 50 when a subsequent ball 5 is received through the attachment 60.

Referring now to FIGS. 5 and 6, a method of assembly the retriever 10 into the ball removal configuration is disclosed. First, the first end 61 of the attachment 60 is removably coupled to the second end 42 of the hopper body 40 as was disclosed previously with respect to discussion of the ball retrieval process. In some circumstances, the attachment 60 may already be coupled to the hopper body 40 if the ball removal configuration is employed immediately following the completion of a ball retrieval process utilizing the retrieval structure 65 of the attachment 60 as disclosed hereinabove. Next, the second end 22 of the lid 20 is coupled to the second end 62 of the attachment 60 via the threaded mating of the threaded portions 34, 72. The first end 21 of the lid 20 as formed by the rim 26 and the handle 27 is thus positioned to act as the base or the support surface of the retriever 10 for facilitating the orienting of the retriever 10 in an upright position with respect to the direction of gravity. The positioning of the lid 20 adjacent the second end 42 of the hopper body 40 also opens the first end 41 of the hopper body 40 for access to the balls 5 stored within the storage space 50. The upright and open configuration of the hopper body 40 accordingly allows for the user to access the contents of the storage space 50 from a standing position as would be typical during a typical training session, thereby facilitating an ease of removal of the balls 5 from the hopper body 40.

The lid 20 accordingly serves the dual functions of preventing undesired removal of the balls 5 through the open first end 41 of the hopper body 40 and providing a support structure for establishing an upright position of the retriever 10 when removal of the balls 5 is desired. The use of the lid 20 accordingly simplifies and reduces the cost to manufacture the retriever 10 by eliminating any additional components or structures that would otherwise be necessary for establishing such relationships.

The retriever 10 is shown and described in FIGS. 1-6 with reference to only a single attachment 60 that is removably coupled to the hopper body 40. However, the retriever 10 is configured for interchangeable use with any of a plurality of different attachments, wherein each of the different attachments is configured for use with balls of a different range of outer diameters. For example, FIGS. 7A-9B illustrate three different attachments 91, 92, 93 that each have the same essential structural characteristics as the described attachment 60, thereby allowing for each of the attachments 91, 92, 93 to be interchangeably removably coupled to the second end 42 of the hopper body 40 as well as the second end 22 of the lid 20 in identical fashion to the attachment 60. The retriever 10 according to the present invention is therefore advantageously adaptable for the retrieval and storage of sports balls of varying outer diameters via the interchangeability of the attachments 91, 92, 93 relative to the hopper body 40 and the lid 20.

Figure 9A:
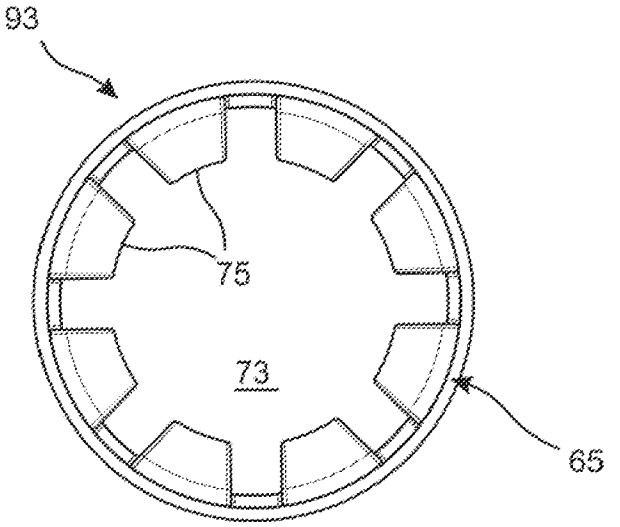
FIG. 9A is a bottom plan view of a third attachment configured for removable coupling to the sport ball retriever assembly of FIG. 1.
Figure 9B:
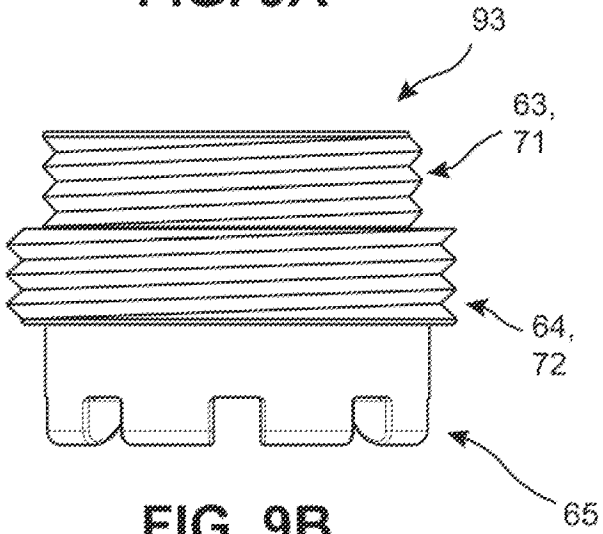
FIG. 9B is a side elevational view of the third attachment of FIG. 9A.
Figure 8A:
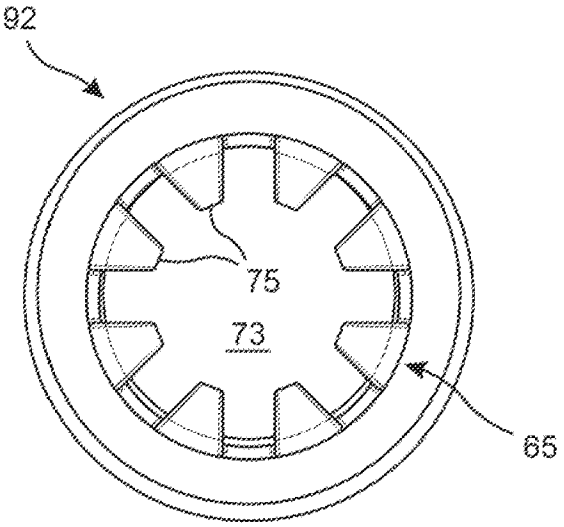
FIG. 8A is a bottom plan view of a second attachment configured for removable coupling to the sport ball retriever assembly of FIG. 1.
Figure 8B:
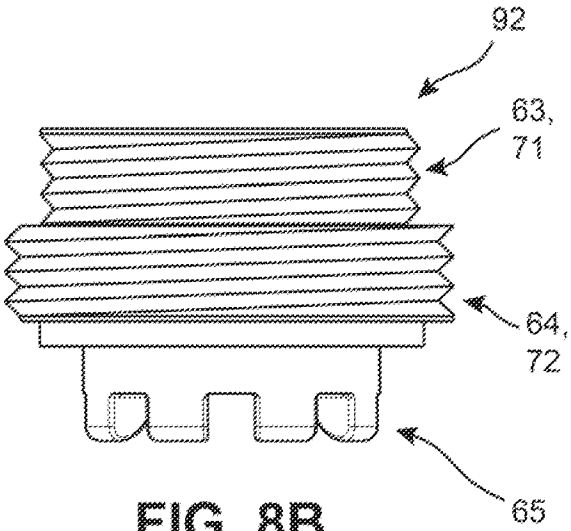
FIG. 8B is a side elevational view of the second attachment of FIG. 8A.
Figure 7A:
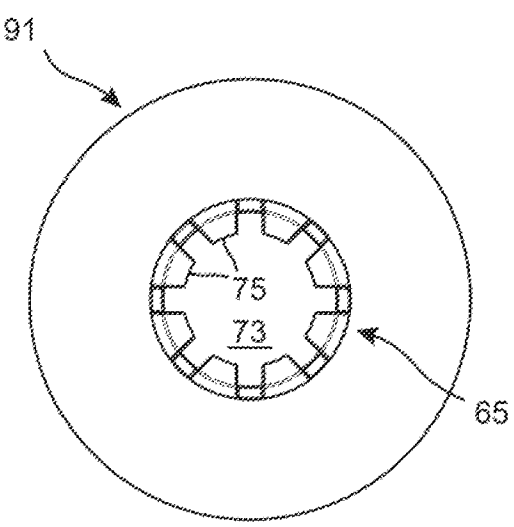
FIG. 7A is a bottom plan view of a first attachment configured for removable coupling to the sport ball retriever assembly of FIG. 1.
Figure 7B:
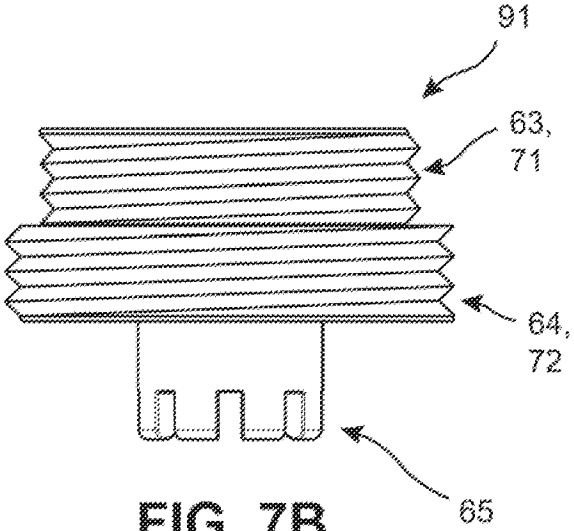
FIG. 7B is a side elevational view of the first attachment of FIG. 7A.

As can be seen by comparison of FIGS. 7B, 8B, and 9B, the coupling segments 63, 64 and the corresponding threaded portions 71, 72 of each of the different attachments 91, 92, 93 include identical structures and dimensions to facilitate the interchangeable nature of each of the attachments 91, 92, 93 with respect to the hopper body 40 and the lid 20.

As best shown in FIGS. 7A, 8A, and 9A, the attachments 91, 92, 93 vary from each other by including different configurations and/or dimensions of the respective retrieval structures 65 and the respective through holes 73 formed through each of the attachments 91, 92, 93. FIGS. 7A and 7B illustrate a first attachment 91 having a through hole 73 and a retrieval structure 65 dimensioned to allow for the unidirectional passage of a first range of ball diameters therethrough, FIGS. 8A and 8B illustrate a second attachment 92 having a through hole 73 and a retrieval structure 65 dimensioned to allow for the unidirectional passage of a second range of ball diameters therethrough, and FIGS. 9A and 9B illustrate a third attachment 93 having a through hole 73 and a retrieval structure 65 dimensioned to allow for the unidirectional passage of a third range of ball diameters therethrough. The first range of ball diameters includes ball diameters that are less than the ball diameters corresponding to the second range of ball diameters, and the second range of ball diameters includes ball diameters that are less than the ball diameters corresponding to the third range of ball diameters. As one example, the attachment 91 may be suitable for retrieving relatively small balls such as golf balls, the attachment 92 may be suitable for retrieving intermediate sized balls such as baseballs, tennis balls, and cricket balls, and the attachment 93 may be suitable for retrieving relatively large balls such as softballs.

In each case, the range of ball diameters configured for unidirectional passage through one of the attachments 91, 92, 93 is determined by the dimensions of the corresponding through hole 73 and the respective fingers 75 forming the corresponding retrieval structure 65. Specially, a maximum outer diameter of the balls capable of unidirectional passage through each of the attachments 91, 92, 93 is determined by the inner diameter of the corresponding through hole 73, which also corresponds to a distance between the flexible portions 76 of diametrically opposing ones of the fingers 75, wherein only those balls having an outer diameter less than the inner diameter of the through hole 73 are capable of axial passage through the corresponding attachment 91, 92, 93. On the other hand, a minimum outer diameter of the balls capable of unidirectional passage through each of the attachments 91, 92, 93 is determined by the radial distance present between a central axis of each respective attachment 91, 92, 93 and the edge 80 formed on each of the fingers 75, wherein only those balls having an outer diameter greater than twice this radial distance are able to be prevented from passing back through the retrieval structure 65 in the axial direction away from the hopper body 40.

As used herein, the phrase "unidirectional passage" indicates that the corresponding one of the balls can pass axially through the corresponding one of the attachments 91, 92, 93 in the retrieval direction (towards the hopper body 40) while not being able to pass axially back through the corresponding one of the attachments 91, 92, 93 in a direction opposite the retrieval direction (away from the hopper body 40). Based on this definition, each of the attachments 91, 92, 93 cannot be said to be configured for unidirectional passage of one of the balls if the corresponding one of the balls is incapable of passing through the corresponding attachment 91, 92, 93 in either of the two axial directions or if the corresponding one of the balls is otherwise capable of passing through the corresponding attachment 91, 92, 93 in both of the axial directions. For example, a ball having a diameter suitable for unidirectional passage through the attachment 91 includes a diameter too small to allow for unidirectional passage through the attachment 93 because such a ball would readily pass between the opposing edges 80 of the fingers 75 of the attachment 93 with respect to both of the axial directions.

The retriever 10 may accordingly be provided for purchase as a kit having some combination of the lid 20, the hopper body 40, and at least two different attachments 91, 92, 93, wherein each of the attachments 91, 92, 93 forming the kit is configured for the unidirectional passage of balls of a different range of outer diameters. Such a kit may include any combination of the attachments 91, 92, 93, and may further include attachments 91, 92, 93 in addition to the exemplary three disclosed herein. The kit including the components forming the retriever 10 is accordingly capable of being adapted for use with spherical sports balls having a variety of different outer diameters, thereby increasing the utility of the retriever 10.

Figure 10:
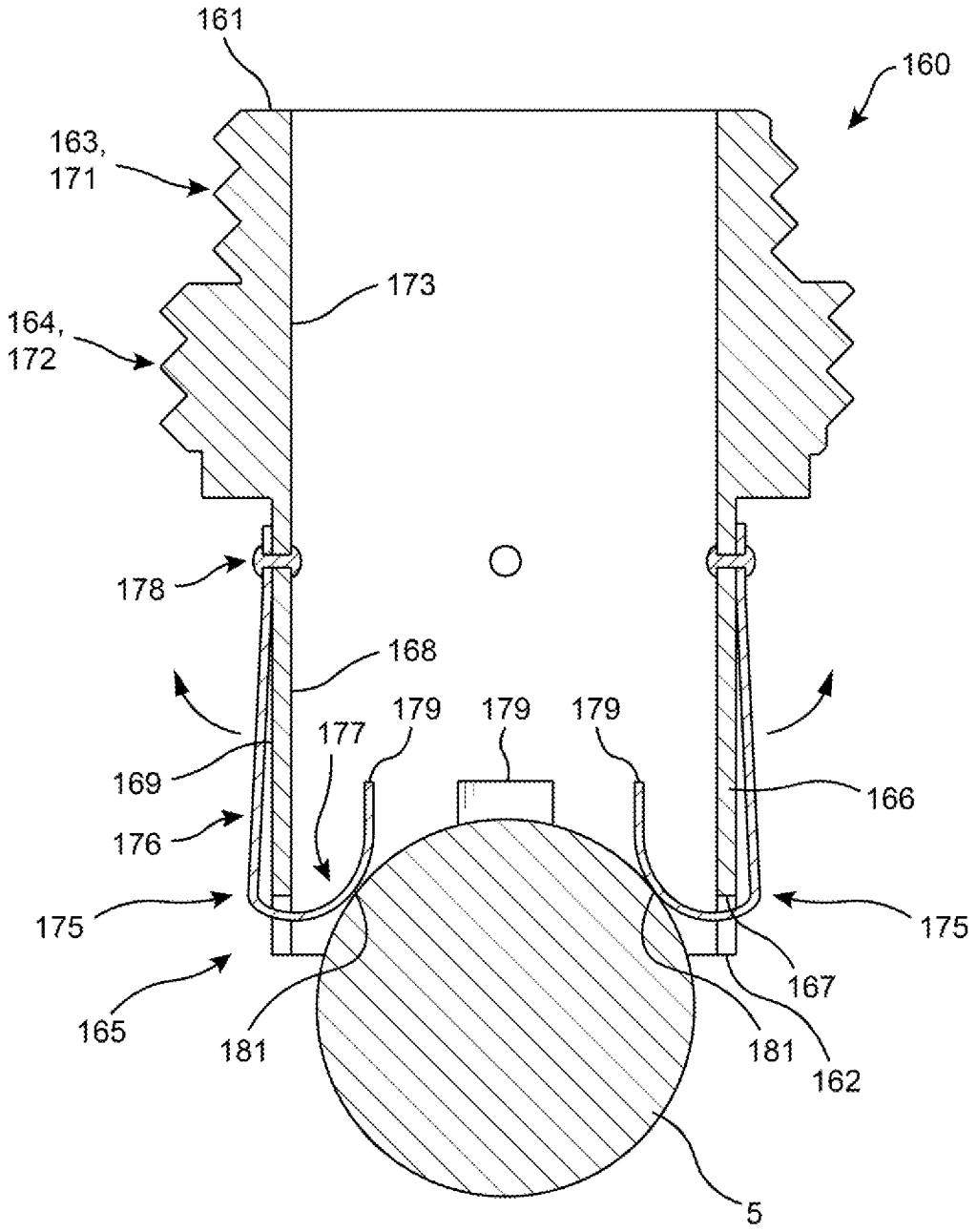
FIG. 10 is an elevational cross-sectional view showing a ball immediately prior to unidirectional passage through a retrieval structure of an attachment according to another embodiment of the present invention.

Referring now to FIG. 10, an attachment 160 according to another embodiment of the present invention is disclosed. The attachment 160 is interchangeable with the attachment 60 and may accordingly be used in conjunction with the previously described lid 20 and hopper body 40 of the retriever 10. The attachment 160 is substantially cylindrical in shape and extends axially from a first end 161 to an oppositely arranged second end 162. The attachment 160 is divided axially into a first coupling segment 163 including the first end 161, a second coupling segment 164 disposed adjacent the first coupling segment 163, and a retrieval structure 165 disposed adjacent the second coupling segment 164 and including the second end 162. In similar fashion to the attachment 60, the first coupling segment 163 includes a first threaded portion 171 configured for threaded engagement with the second threaded portion 58 of the hopper body 40 while the second coupling segment 164 includes a second threaded portion 172 configured for threaded engagement with the second threaded portion 34 of the lid 20. The attachment 160 is accordingly capable of being used in place of the attachment 60 for achieving either of the configurations of the retriever 10 as disclosed with reference to FIGS. 3 and 6.

The attachment 160 differs from the attachment 60 by including an alternative configuration of the retrieval structure 165 in comparison to the retrieval structure 65, although the retrieval structure 165 operates in substantially the same manner as described hereinafter. The retrieval structure 165 includes a cylindrical wall 166 extending axially away from second coupling segment 164 with a distal end of the cylindrical wall 166 forming the second end 162 of the attachment 160. The cylindrical wall 166 includes a plurality of indentations 167 formed therein at the second end 162 of the attachment 160. An inner circumferential surface 168 of the cylindrical wall 166 defines a portion of a through hole 173 extending axially through an entirety of the attachment 160.

The retrieval structure 165 further includes a plurality of fingers 175 spaced circumferentially about the cylindrical wall 166 with each of the fingers 175 corresponding to one of the indentations 167 formed in the second end 162. Each of the fingers 175 is provided as a strip of material having an arm 176 and a hooked portion 177. The arm 176 forms a flexible portion of each of the fingers 175 while the hooked portion 177 forms a contact portion of each of the fingers 175 that is configured for contact with a ball 5 during a retrieval process.

The arm 176 of each finger 175 is elongate and extends from an anchor end 178 of the corresponding finger 175 to the hooked portion 177 thereof. The anchor end 178 of each of the fingers 175 is coupled to the cylindrical wall 166 adjacent the second coupling segment 164 of the attachment 160 with the arm 176 of each finger 175 extending axially outside of the through hole 173 adjacent an outer circumferential surface 169 of the cylindrical wall 166. In the illustrated embodiment, the anchor end 178 is coupled to the cylindrical wall 166 using a rivet, but any coupling means or mechanism may be used to couple each finger 175 to the cylindrical wall 166, including the use of a suitable fastener or the use of an aggressive joining method, as non-limiting examples.

The hooked portion 177 of each finger 175 curves through a corresponding one of the indentations 167 such that the hooked portion 177 does not extend axially beyond the second end 162 of the attachment 160 when passing from an exterior to an interior of the through hole 173. A free end 179 of each finger 175 is disposed at the end of the hooked portion 177 at a position spaced radially inwardly from the inner circumferential surface 168 at a position also within the through hole 173. The free end 179 of each finger 175 forms a stopping surface for preventing undesired axial removal of a ball already having passed by the fingers 175 when being retrieved by the retriever 10. The hooked portion 177 includes a radially inwardly facing tapered surface 181 adjacent the second end 162 of the attachment 160. The tapered surface 181 is shown as being substantially convex and arcuate, but other tapered shapes may be used without departing from the scope of the present invention.

The retrieval structure 165 is shown as including four of the indentations 167 and a corresponding four of the fingers 175 arranged in two diametrically opposing pairs, but alternative numbers of the indentations 167 and fingers 175 may be utilized while still maintaining the same general method of operation of the retrieval structure 165.

Each of the fingers 175 may be formed from an elastically or resiliently flexible material capable of withstanding multiple different cycles of operation of the retrieval structure 165. Each of the fingers 175 may be formed from a suitable metallic material or plastic material, as desired. The finger 175 and the remainder of the attachment 160 may be formed from the same materials or from different materials. The fingers 175 and/or the remainder of the attachment 160 may be formed from any of the materials described as being suitable for forming the attachment 60.

The retrieval structure 165 operates in substantially the same manner as the retrieval structure 65. The ball 5 is received into the end of the cylindrical wall 166 and is centered when contacting the tapered surface 181 of each of the fingers 175. As the ball 5 is pushed into the cylindrical wall 166, each of the fingers 175 pivots radially outwardly about the corresponding anchor end 178 thereof with the tapered surface 181 moving radially outwardly to increase a radial distance present between a central axis of the cylindrical wall 166 and each of the tapered surface 181 and the free end 179 of the corresponding finger 175. The ball 5 eventually passes through the fingers 175 and ceases to engage the fingers 175, at which point each of the fingers 175 springs back to an original position thereof. The free end 179 of each of the fingers 175 is then positioned to form a stopping surface for preventing reverse axial motion of the ball 5. The retrieval structure 165 is accordingly configured for unidirectional passage of the ball 5 in similar fashion to the retrieval structure 65.

Figure 13:
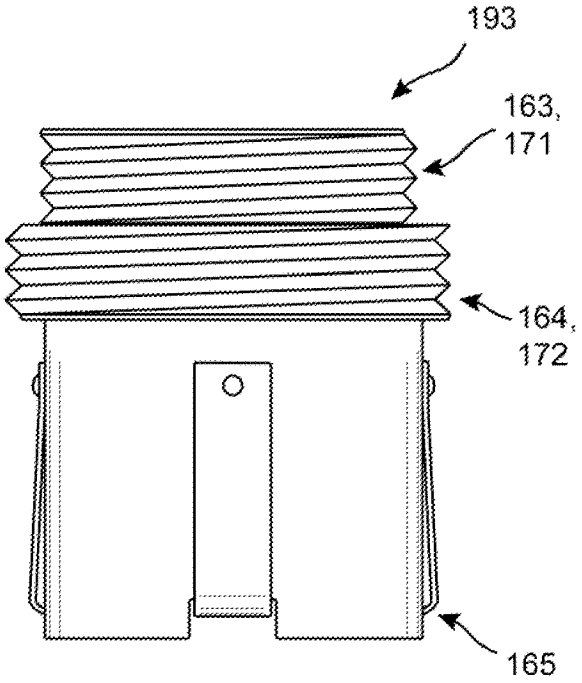
FIG. 13 is a side elevational view of a third attachment configured for use with the sport ball retriever assembly of FIG. 1.
Figure 12:
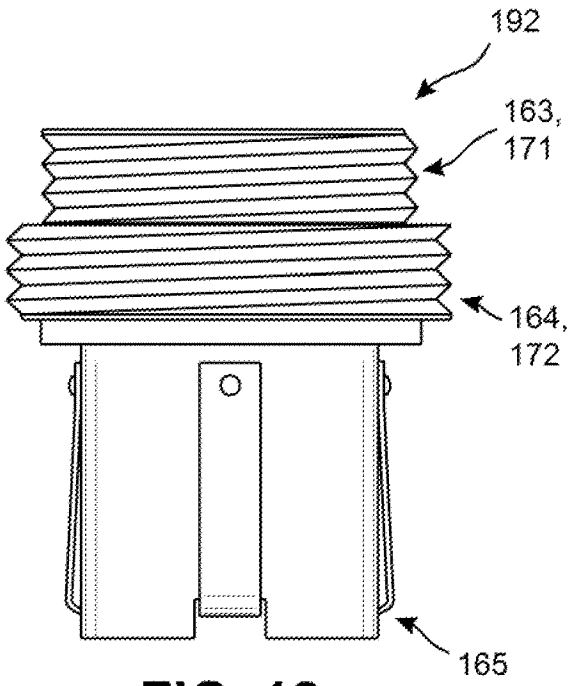
FIG. 12 is a side elevational view of a second attachment configured for use with the sport ball retriever assembly of FIG. 1.
Figure 11:
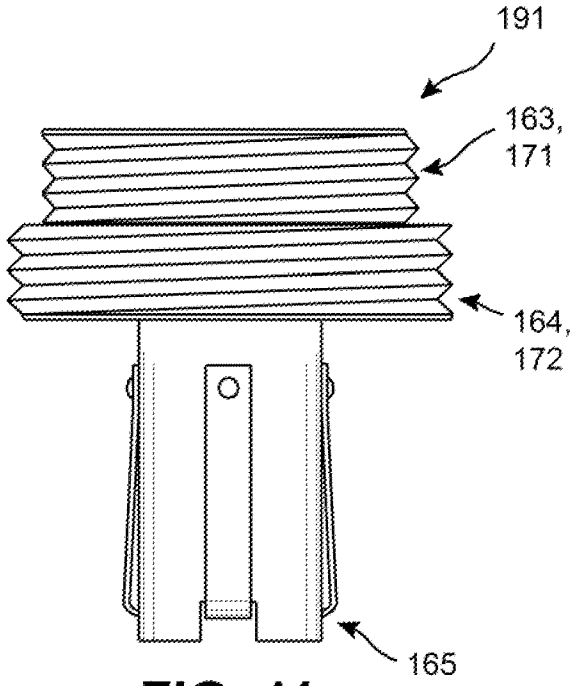
FIG. 11 is a side elevational view of a first attachment configured for use with the sport ball retriever assembly of FIG. 1.

Referring now to FIGS. 11-13, the structure of the attachment 160 may also be expanded to accommodate multiple different ball sizes in similar fashion to the attachment 60. As is evident from review of FIGS. 11-13, each of a first attachment 191, a second attachment 192, and a third attachment 193 include identical first coupling segments 163, second coupling segments 164, first threaded portions 171, and second threaded portions 172 to allow for each of the attachments 191, 192, 193 to be interchangeably removably coupled to the lid 20 and the hopper body 40 as is described herein. The first attachment 191 is configured for unidirectional passage of relatively small balls such as golf balls, the second attachment 192 is configured for unidirectional passage of intermediate balls such as baseballs, cricket balls, and tennis balls, and the third attachment 193 is configured for unidirectional passage of relatively large balls such as softballs. The range of balls configured for respective use with each of the attachments 191, 192, 193 is determined by the inner diameter of the respective through hole 173 as well as the radial distance present between the central axis of the cylindrical wall 166 and the free end 179 of each of the fingers 175 (or alternatively the distance between the free ends 179 of diametrically opposing ones of the fingers 175). Any combination of the attachments 191, 192, 193 may also be used in a kit including the lid 20 and the hopper body 40. The attachments 191, 192, 193 may replace the attachments 91, 92, 93 or may supplement the attachments 91, 92, 93 with respect to such a kit, as desired.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A ball retriever assembly for retrieving and storing balls, the retriever assembly comprising:

a hopper body defining a hollow storage space therein;

at least one attachment configured for removable coupling to the hopper body, each of the at least one attachments including a retrieval structure configured for unidirectional passage of one of the balls through the corresponding one of the at least one attachments; and a lid configured for removable coupling to the hopper body and each of the at least one attachments;

wherein the lid forms a stand for supporting the hopper body when the lid is removably coupled to one of the at least one attachments.

2. The retriever assembly of claim 1, wherein the at least one attachment includes a first attachment and a second attachment, wherein the first attachment and the second attachment are interchangeably removably coupled to the hopper body.

3. The retriever assembly of claim 2, wherein the retrieval structure of the first attachment is configured for the unidirectional passage of a first ball therethrough and the retrieval structure of the second attachment is configured for the unidirectional passage of a second ball therethrough, wherein the first ball and the second ball have different outer diameters.

4. The retriever assembly of claim 2, wherein the first attachment and the second attachment each include a first threaded portion configured for interchangeably mating with a corresponding threaded portion of the hopper body, wherein the first threaded portion of the first attachment is identical in structure to the first threaded portion of the second attachment.

5. The retriever assembly of claim 4, wherein the first attachment and the second attachment each include a second threaded portion configured for interchangeably mating with a corresponding threaded portion of the lid, wherein the second threaded portion of the first attachment is identical in structure to the second threaded portion of the second attachment.

6. The retriever assembly of claim 1, wherein the retrieval structure of each of the at least one attachments includes an annular array of fingers configured to flex radially outwardly during the unidirectional passage of one of the balls through the corresponding one of the at least one attachments.

7. The retriever assembly of claim 6, wherein each of the fingers includes an axially extending flexible portion and a radially inwardly extending contact portion, wherein each of the fingers is configured to flex radially outwardly about the flexible portion of the corresponding finger when one of the balls is pressed axially against the contact portion of the corresponding finger.

8. The retriever assembly of claim 7, wherein the contact portion of each of the fingers includes a tapered surface.

9. The retriever assembly of claim 7, wherein the contact portion of each of the fingers forms a stopping surface for preventing bidirectional passage of one of the balls through the corresponding one of the at least one attachments.

10. The retriever assembly of claim 6, wherein each of the fingers is one of formed from a strip of a resiliently flexible material coupled to the corresponding one of the at least one attachments or a monolithically formed extension of the corresponding one of the at least one attachments.

11. The retriever assembly of claim 1, wherein the hopper body extends axially from a first end to an opposing second end, wherein the lid is configured for removable coupling to the first end of the hopper body and each of the at least one attachments is configured for removable coupling to the second end of the hopper body.

12. The retriever assembly of claim 1, wherein each of the at least one attachments includes a first threaded portion configured for threaded engagement with a threaded portion of the hopper body and a second threaded portion configured for threaded engagement with a threaded portion of the lid.

13. The retriever assembly of claim 1, wherein the lid includes a first threaded portion configured for threaded engagement with a threaded portion of the hopper body and a second threaded portion configured for threaded engagement with a threaded portion of each of the at least one attachments.

14. A kit for forming a ball retriever assembly, the kit comprising:

a hopper body defining a hollow storage space therein;

a plurality of attachments, each of the attachments configured for removable coupling to the hopper body, each of the attachments including a retrieval structure configured for unidirectional passage of balls therethrough, wherein each of the retrieval structures is configured for the unidirectional passage of a different range of ball outer diameters therethrough; and a lid configured for removable coupling to the hopper body and each of the attachments.

15. A ball retriever assembly for retrieving and storing balls, the retriever assembly comprising:

a hopper body defining a hollow storage space therein;

at least one attachment configured for removable coupling to the hopper body, each of the at least one attachments including a retrieval structure configured for unidirectional passage of one of the balls through the corresponding one of the at least one attachments; and a lid configured for removable coupling to the hopper body and each of the at least one attachments, wherein the lid includes a first threaded portion configured for threaded engagement with a threaded portion of the hopper body and a second threaded portion configured for threaded engagement with a threaded portion of each of the at least one attachments.

16. The retriever assembly of claim 15, wherein the retrieval structure of each of the at least one attachments includes an annular array of fingers configured to flex radially outwardly during the unidirectional passage of one of the balls through the corresponding one of the at least one attachments.

17. The retriever assembly of claim 16, wherein each of the fingers includes an axially extending flexible portion and a radially inwardly extending contact portion, wherein each of the fingers is configured to flex radially outwardly about the flexible portion of the corresponding finger when one of the balls is pressed axially against the contact portion of the corresponding finger.

18. The retriever assembly of claim 17, wherein the contact portion of each of the fingers forms a stopping surface for preventing bidirectional passage of one of the balls through the corresponding one of the at least one attachments.

19. The retriever assembly of claim 16, wherein each of the fingers is one of formed from a strip of a resiliently flexible material coupled to the corresponding one of the at least one attachments or a monolithically formed extension of the corresponding one of the at least one attachments.

20. The retriever assembly of claim 15, wherein the at least one attachment includes a first attachment and a second attachment, wherein the first attachment and the second attachment are interchangeably removably coupled to the hopper body, and wherein the retrieval structure of the first attachment is configured for the unidirectional passage of a first ball therethrough and the retrieval structure of the second attachment is configured for the unidirectional passage of a second ball therethrough, wherein the first ball and the second ball have different outer diameters.

* * * * *